United States Patent [19]

Koslar

[11] Patent Number: 4,746,771

[45] Date of Patent: May 24, 1988

[54] SLIDE SWITCH

[75] Inventor: Manfred Koslar, Berlin, Fed. Rep. of Germany

[73] Assignee: Createc Gesellschaft für Elektrotechnik mbH, Berlin, Fed. Rep. of Germany

[21] Appl. No.: 5,192

[22] PCT Filed: Mar. 27, 1986

[86] PCT No.: PCT/DE86/00141

§ 371 Date: Nov. 26, 1986

§ 102(e) Date: Nov. 26, 1986

[87] PCT Pub. No.: WO86/05920

PCT Pub. Date: Oct. 9, 1986

[30] Foreign Application Priority Data

Mar. 27, 1985 [DE] Fed. Rep. of Germany ..... 3511600

[51] Int. Cl.[4] ..... H01H 15/06

[52] U.S. Cl. ..... 200/16 D

[58] Field of Search ..... 200/16 B, 16 C, 16 D, 200/16 E, 16 F, 252, 254, 292

[56] References Cited

U.S. PATENT DOCUMENTS

| | | | |
|---|---|---|---|
| 3,188,403 | 6/1965 | Semo | 200/16 F X |
| 3,582,578 | 6/1971 | Lockard | 200/16 D |
| 3,610,845 | 10/1971 | Lewandowski | 200/16 F |
| 3,745,270 | 7/1973 | Granitz | 200/16 D |
| 3,800,107 | 3/1974 | Heide | 200/16 D |
| 3,896,276 | 7/1975 | Held | 200/16 D |
| 4,072,833 | 2/1978 | Carena | 200/16 D |
| 4,075,442 | 2/1978 | Fukuda et al. | 200/16 F |
| 4,291,210 | 9/1981 | Wolber et al. | 200/16 F X |

FOREIGN PATENT DOCUMENTS

| | | | |
|---|---|---|---|
| UM1998149 | 2/1968 | Fed. Rep. of Germany . | |
| 1665357 | 6/1970 | Fed. Rep. of Germany . | |
| 1811394 | 6/1970 | Fed. Rep. of Germany .... | 200/16 F |
| 2549593 | 5/1976 | Fed. Rep. of Germany . | |
| 1334733 | 7/1963 | France . | |

*Primary Examiner*—J. R. Scott

*Attorney, Agent, or Firm*—Spencer & Frank

[57] ABSTRACT

A multi-pole slide switch for an electrical apparatus processing signals having fixed contact areas provided on both sides on an insulated support layer in the form of a printed circuit board, and a switch slider with generally omega-shaped contact elements enclosing the edge of the support layer and resting resiliently against it for the alternate connection of contact areas respectively opposite each other, wherein the switch slider has chamber-like recesses, into which the contact elements are loosely inserted, wherein the discrete contact elements are movable by a set amount in a direction parallel to the direction of the contact pressure and/or are mounted within the recess rotatably around an axle pointing in the direction of switching.

20 Claims, 6 Drawing Sheets

SLIDE SWITCH

BACKGROUND OF THE INVENTION

1. Field of the Invention

The present invention relates to a multi-pole slide switch for an electrical apparatus having fixed contact areas provided on both sides of an insulated support layer in the form of a printed circuit board and a switch slide with contact elements enclosing the edge of the support layer and resting resiliently against it for alternate connection of contact areas respectively opposite one another.

2. Discussion of the Prior Art

A prior art slide switch is known from the German utility design No. 1 998 149.

However, this switch has the disadvantage that the contact elements are firmly riveted at their back with the slide. Thus the resilient ends of the contact elements can follow height tolerances only by giving within the spring excursion. Because of this, the force of pressure is reduced on the one side while rising on the opposite side. Contact deterioration on the one hand and increased wear on the other are the result.

SUMMARY OF THE INVENTION

The object of the present invention is to improve such a switch in such a way that the contact characteristics are maintained even with the assembly variations which occur, and when the switch is activated frequently.

Another object of the invention is that the switch should be produceable at moderate cost from a few parts.

The invention is based on the recognition that, by the use of contact elements surrounding the support of the contact areas, in a variation-free construction the contact forces on both sides are even and therefore the operating characteristics of both contact zones agree—however, unwanted deviations occur in reality and these deviations lead to deterioration.

In the invention, the omega-shaped spring elements automatically adjust themselves during assembly and bring an identical pressure force to bear on both contact surfaces. The respective elements are completely independent of one another in regard to their guidance crosswise to the switching direction.

Based on the form of the chambers, the contact elements are secured against falling out even in the non-assembled state of the switch sliders. For assembly the contact elements only need to be guided into the chambers by slight pressure and, because of the arc-like expansion of their omega shape, snap in place there. In order to make contact, the beak-shaped area "riding" on the support element is preferably formed convexly on all sides in the direction of the contact surfaces. Because of the correspondingly expanding opening of the "beak-like" end of the contact elements, the pre-assembled switch slider element containing the contact elements can be assembled in a single step.

By means of the mechanical decoupling of the omega-shaped contact elements in the directions other than those corresponding to the slide direction for the operation as a switch, it is possible to transfer the mechanical actuation steps from an externally guided slide handle element to the switch slider within the required tolerances, wherein the slide handle element can remain connected to the housing and preferably only has force transfer surfaces with small permissible tolerances in the direction of sliding. Since the handle element is guided in the housing by means of a corresponding recess, labyrinth-like leakage distances can be advantageously provided to obtain functional safety, which is of especially essential significance in compact measuring instruments used with high voltage applications.

The ability of self-adjustment, caused by the float mounting of the several contact elements, is so great that several neighboring printed circuit cards having contact areas can be operated by switch sliders rigidly connected with one another.

Thus, with a stacked arrangement of the cards a plurality of switch sliders can be activated with a single handle element, acting on different cards, so that in an advantageous improvement, corresponding to the given requirements for complex switchings affecting several switching steps in connection with an operational switch-over, etc., access to several cards is possible in a compact construction form. Nevertheless, the cards can be placed relatively close together depending on the commercially available components in the micro-electronic field, since the switch sliders also are of small construction. The provision of a mechanical switch arrangement with which the most extensive switching operations can be performed will hardly contribute to an increase of the structural size of the finished apparatus.

Since the tolerances in the sliding direction during force transfer have been chosen relatively small—in a preferred development of the invention—the switch detents are also connected with the housing in the form of pins or denticulations, so that no special steps for this need to be taken on the printed circuit cards. Such denticulations can be created on printed circuit cards only with relatively costly measures while they can be simply extruded in connection with a plastic housing.

In a measuring apparatus in the form of a universal signal processing device having a flat rectangular housing, the slide switch according to the invention is provided on one of the short sides and can be operated there in an ergonomically advantageous way—for example by the thumb—when holding the device in the hand. Thus the entire frontal area is open to the view of the operator and with the other hand further switching changes can be performed in the inside of the device via actuating elements provided on the front surface, which, however, preferably effect switchings by software in the measuring program, while the concept of a switch according to the invention shown here preferably has its effect on the signal path in such a way that complete galvanic separations are achieved which could not easily be effected by program-driven switching elements.

Through a transparently formed front surface the control elements of the slide switch and especially conspicuous markings can be recognized, so that the position of the switch can always be checked—preferably with corresponding thermometric scales—without having to look at the sides of the apparatus, where the position of the switch would be hard to see, anyway, since the mechanical operating lever would, in its various positions, cover a part of the symbols and marks on the surfaces available there.

Screening for the switch contacts required for assuring undisturbed operation of the apparatus can be applied in a U-shaped design and thereby surrounding the contacts, also U-shaped, within the switch slider in the form of flat surfaces, above and below the respective areas of the printed circuit boards effected by the switch slider, wherein in accordance with a preferred embodiment of the invention the movable U-shaped screening which is connected with the switch slider makes the required contact with the screenings disposed fixedly above and below the board or provided as strip conductors on the board by means of a wiper.

Guidance of the handle element for the switch slider is provided by a sliding piece preferably in such a way that the tracks are formed at a partition of the housing, so that the handle element can be inserted before assembly of the housing and can be fastened (with the exception of in the direction of sliding) when the housing segments are connected. These tracks, too, contribute by means of their surfaces at different angles to each other to an increase in the leakage distances required for electrical safety.

The slide switch can also be inserted with the housing removed for test purposes, so that the complete operation of the apparatus is also assured when the housing is removed for assembly or servicing.

Special difficulties are encountered in the assembly of the species of apparatus described here. Since very little space is available and the complexity of the switch functions is comparatively very high and since, additionally, the ease of operation, the design and the safety are influenced by this component, the switch had to be developed according to partially completely novel principles of construction.

It is known that in standard measuring apparatus, even in small "hand held" varieties, switches are mostly obtained from other sources in the form of purchased or added parts. This results in the disadvantage of too large sizes and the necessity of providing openings and switch designs based on the standard elements selected.

Because of the design of the supporting layer having slits oriented crosswise from the slide direction between the contact areas, the self-cleaning of the contacts is also present when there is wear caused by frequent operation or other displacement of the contact material.

On the other hand, switch elements are often the cause of a lack of dependability of the devices. In regard to a total concept of an apparatus which is to be created, it is an essential object to develop a switch which fulfills the special requirements made by the compactness and complexity of modern circuitry as well as of cost-effective manufacture and reproducability in construction at the same time, especially since a number of physical and technological requirements must be fulfilled at the same time by the switch according to the invention, which are enumerated below:

The switch should have a small structural size.

A potential for detents should be provided.

As few as possible components are to be used.

As small as possible tolerance requirements should be made on the components.

The materials used should be commonly used in the areas of electronics and precision mechanics.

Manufacture should be reproducible in all its steps.

The switch should contain connecting elements for the creation of bridges between the fixed contacts provided at distances.

The switch should be fixedly combinable with the electronic printed circuit boards, wherein the fixed contacts should also form bridges between strip conductors at relatively larger distances.

A certain contact pressure should possibly be exerted via spring elements.

Making contact should be as much as possible in a plane.

Surfaces as free as possible of oxydation should be available.

The materials should be corrosion-free.

The switch should have a self-cleaning function.

The switch should be wear-safe, i.e. no metallic waste should be created through wear and friction should be as low as possible, but still sufficient for self-cleaning.

The switch should be constructed with a tolerance towards variations in manufacture, i.e. the electrical contact surfaces must not be affected by variations in the mechanical assembly.

The forces exerted on the operational element must be decoupled in respect to the contact elements.

The switch according to the invention fulfills all these requirements in a surprisingly simple way.

A slide switch in a rectangularly-shaped hand-held metering device is easier to operate than a rotary control knob, which always requires another hand to hold on to the apparatus. The contact elements can be accomodated at the edge of the card in such a way that they do not interfere with the remaining structure of the apparatus and, furthermore, the disposition of the switch can be such that the switch knobs essentially occupy the space of the housing wall. Thus the total inner volume of the housing is hardly reduced and remains free for other mechanical inserts.

In this way the switch elements shown here essentially contribute to a universal metering concept which permits the realization, in one and the same housing and by the utilization of extensively compatible electronic printed circuit cards, of a program of devices for the fulfillment of different metering and test and signal processing functions.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENT

Figure 1A:
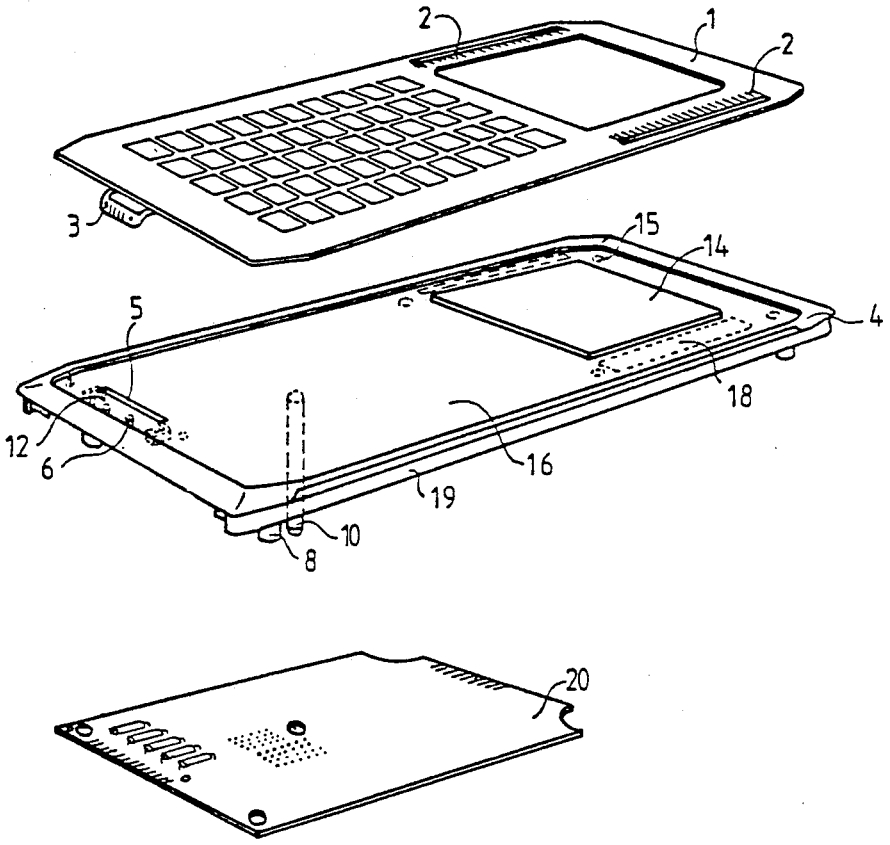
FIGS. 1*a*–1*c* are partial exploded view of elements constituting the exemplary embodiment.
Figure 1B:
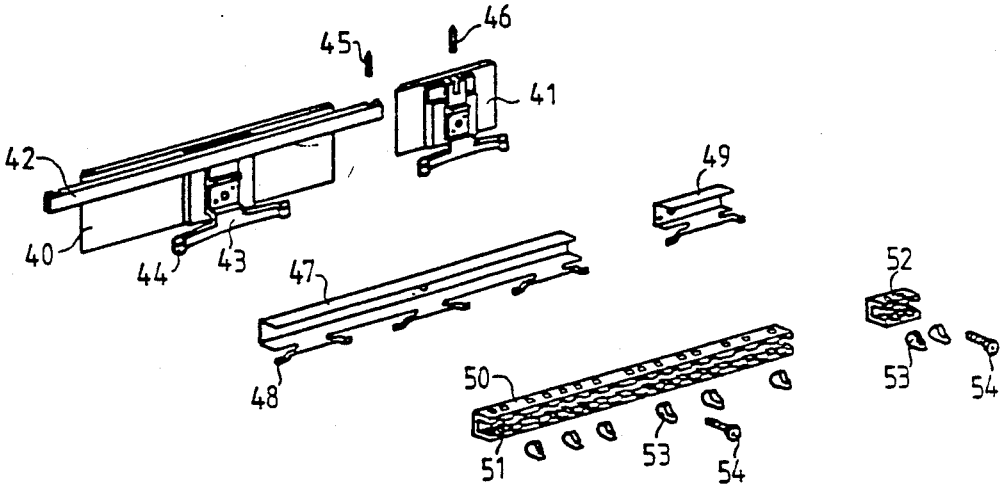
Figure 1B:
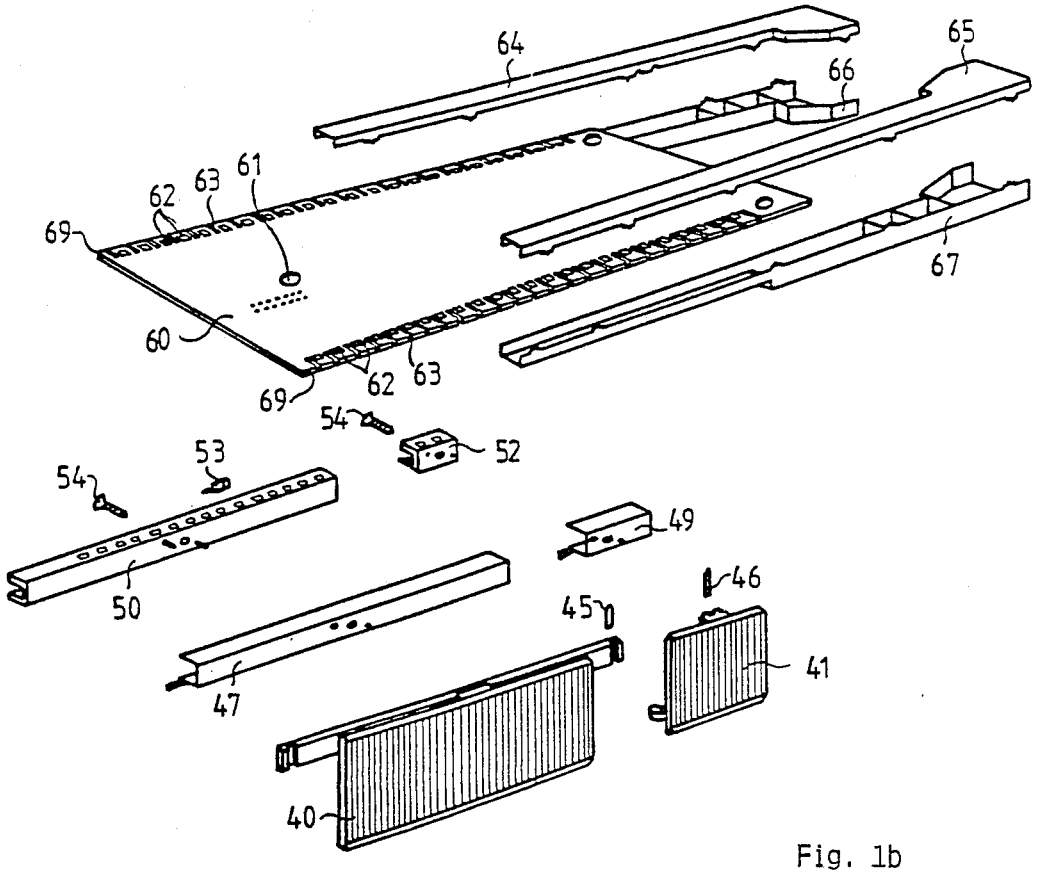

The description of the structural design is made with a simultaneous reference to the different figures, showing the components in different views (exploded or assembled). The description is in the order of the later assembly wherein this is accomplished in the inverted position of the apparatus with the keys on the bottom and building onto them.

In the exemplary embodiment shown a key pad 1 is provided consisting of several insulating and conducting layers, wherein single areas of the internal matrix-like conductor arrangements are put in touch with each other by pressure on the respective surface areas and thereby form the pressure pads of a pad area. The key pad furthermore has on its front side legends indicating the functions to be activated by the respective contact areas of the pad area. Additionally, scales 2 are shown on the front panel indicating the functional positions of further switch elements disposed on the side surfaces of the housing. Via further recesses the position of the respective elements are readable from above, if these parts contain movable indicators in the form of dial pointers or the like. The markings frame a recess for a display. All information to be optically received for operation and reading is therefore displayed on the upper surface of the apparatus—facing the operator—. All connections for the key pad are carried by a bracket 3 in the form of parallel strip conductors.

In the exemplary embodiment shown, a front panel 4 supporting the key pad is formed totally of a highly transparent plastic and encompasses the following elements in one piece: a window 14 for viewing the display, a further window as scale window 18 to view the movable indicator elements of the switch elements, as well as an area 16 to receive the key pad 1. Beside these functions, the main function of the front panel 4 is to close the housing at the top.

This results in no longer having costly assembly steps or to separately insert transparent windows or pad components—as will be shown in detail hereinbelow. Additionally, no detrimental leakage distances are created.

The front panel 4 has been formed for the advantageous utilization of glueable key pads in such a way, that the rectangular indicator window 14 for the display extends by a few millimeters out of the otherwise level front panel and the remaining area of the plastic part forming the front panel 4 is lowered by parts of a millimeter.

Into this flat recess the key pad 1, having openings but otherwise being non-transparent, is glued so that only the indicator window 14 and the scales 2 located next to this indicator window, remain transparent. The electrical connection of the key pad 1 preferably is accomplished thus that the leakage distance conditions to be observed for the safety of the operator can be maintained by means of a correspondingly formed bonding of the inner circuits of the apparatus.

Narrow rectangular recesses 19 are located on the two front sides which can receive the rectangularly-shaped switches 40 for the mounting of connector elements.

Furthermore, on the inside of the front panel 4 there are provided four locator domes, designated by the holes 15, for the fastening by screwing of a display card 30. Additionally—in about the center of the key pad—there is a mounting pin 10 for the centering and seating of the several printed circuit boards 20, 60 and 70 contained in the apparatus.

Four pins 8, each having an inner bore, are provided on the four corners of the inside of the front panel, which are later used for retaining the screw connection of the entire housing. Furthermore, at the lower part of the front panel 4 there is provided a slit 5, through which the bracket 3 of the key pad 1, in the form of flat cables, can be guided and are taken up on the inside by small pins 6 acting as a help in assembling. The pins 8 have sack bores with threads containing screw openings open to the inside of the apparatus.

Because of the closed form of the front panel the top side of the apparatus is hermetically protected. The front panel 4 is an insulating plastic part sealed in itself, wherein possible leakage distances always include the area of its inner edge which readily results in sufficient protection from touch in accordance with the respective requirements, something not possible in a design having separate key and window inserts.

The key pad 1 is glued to the front of the front panel 4 and the flat cable has been guided to the above referred to slit 5 in such a way that it points into the inside of the apparatus so that the front panel 4 is inserted in a thus formed assembly receptacle in a simple manner with the front end downwards. The flat cable is inserted into two small receiving pins 6, wherein a crenelated rubber strip is fitted into two frame-like adjustment elements, and is connected with printed circuit board 20. The slit in the sturdy front panel 4 has been arranged in such a way that, during essentially straight-line piercing, no areas of the board are touched which contain dangerous voltages or currents. The connections on the printed circuit board 20 leading to the contact elements are equipped with protective resistors forming highly resistive actual resistances and assure that all connections in the corresponding outer zone of the board 20, including touch pad conductor and touch pad 1, are protected. The area of the high-voltage resistant resistors is free of leakage distances and strip conductors.

The first of the circuit cards carrying electronic components, designated here control card, is inserted over a pin 10, screwed onto both screw pins and fixed by resilient tubular pieces 9.

Two additional crenelated rubber strip devices are disposed on the board 20. One serves to receive the touch pad contacts, the other as a contact with the display card, which is fastened by means of two screws 12.

A further circuit board 60, together with switch elements 50, 52, screw 54, has been inserted on the assembly device, formed by the front panel in its bottom position, in such a way that the leakage distance strips on the respective longitudinal edges of the front panel at the same time act as sliding means for the switches.

A circuit board 70 containing the microprocessor is inserted on the top and also over the central pin 10 and is fastened by means of resilient tubular spacers. The front panels 75 and 80 are inserted with the plugs and soldered.

The actual housing is formed by the lower part of the housing 85. It is formed as a plastic part in such a way that it has recesses 89 on the sides for receiving the slide switches as a complementary part to the front panel 4. Furthermore, recesses 90 are provided to receive the front panels 75 and 80 and housing screws 86.

The lower part of the housing 85 is made of an opaque plastic and contains slits in the form of deep U-shaped grooves 91 or in the form of additional areas—recessed into the housing part—not accessible from the outside, which form leakage distances.

The four receptor pins 92 for the housing screws 86 are formed in such a way that they, in turn, surround the pins 8 of the front panel 4 in a tubular manner in order to give them additional support when the plastic parts are screwed together.

The bearing surfaces for the housing screws 86 are recessed in order to make allowance for the safety aspect by providing an additional leakage distance on the one hand and, on the other, to make it possible to press into the hollow cylinders of the screw bores cylindrical cover elements 88 which serve as measures against unauthorized opening, for purposes of warranties and for safety.

The housing 85 shows on its bottom panel at the edge of the side surfaces a number of cylindrical pins 93 which are extruded together with the bottom. These pins serve as stops for the slide switches which slide along these compact cylinders and report the stop effect acoustically and mechanically when the slide switches are operated.

These stop elements can also be provided in the front panel 4 in an alternate embodiment. In the exemplary embodiment shown here they were located in the lower part of the housing for reasons of the spatial disposition of the remaining components.

A plate-shaped receiver 94 for adjustment purposes is provided geometrically opposite the pin 10 of the front panel 4.

A support stand 95 can be inserted into polygonal, i.e. dodecahedronal receptacles on the side of the lower part of the housing 85, made from a transparent material and mountable at different angles, so that an advantageous viewing angle corresponding to the lighting conditions can be freely selected. In a position turned by 180° the support stand 95 can also be used as a cover for the key pad and guards against undesired misuse. Feet 96 protect the stand from scratching. A type plate 97 is recessed in the support stand and is visible in the covering position.

Figure 1C:
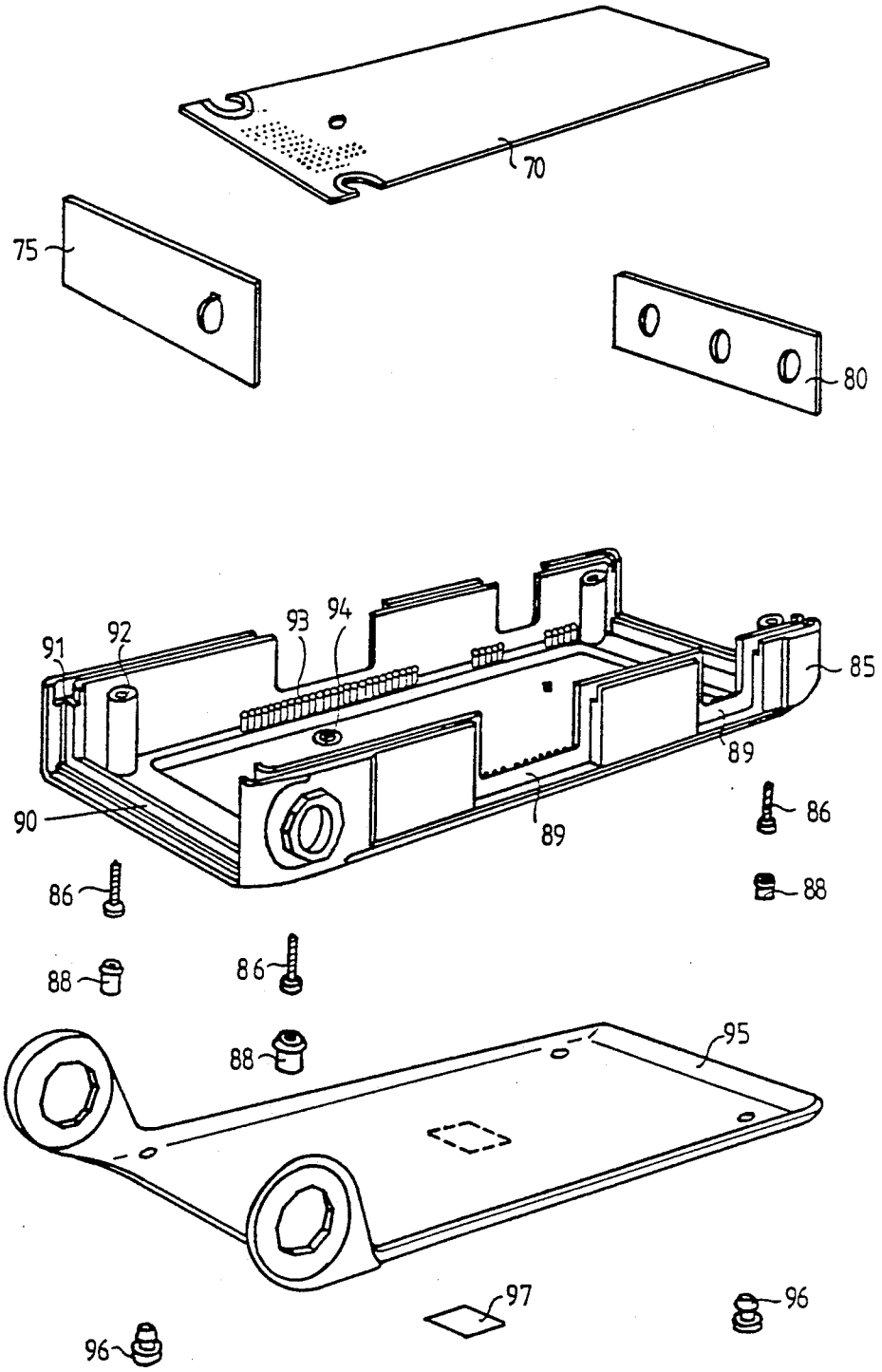
Figure 2:
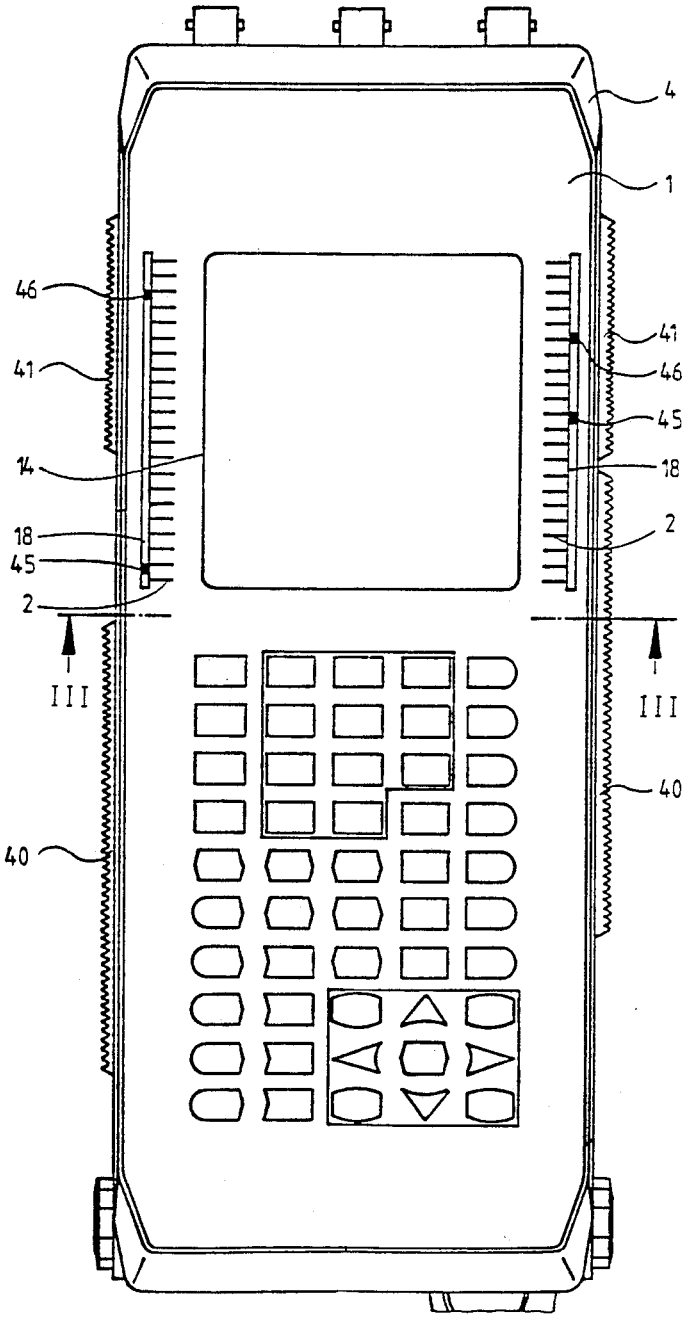
FIG. 2 is a top view of the apparatus, FIG. 3 a perspective cross section (III—III) through the assembled apparatus indicated in FIG. 2.
Figure 3:
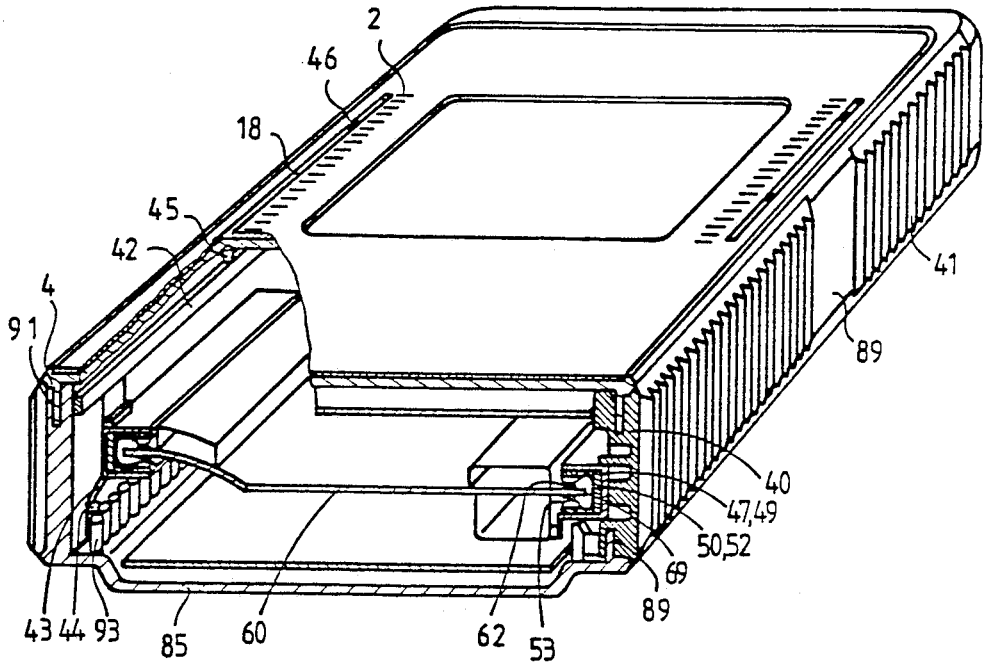

The switch component can be seen in the partial views according to FIG. 3 and the exploded view according to FIG. 1*c*. It represents an essential component of the electronic apparatus described above. Because of the special way the slide switch cooperates with the housing, advantages of the switch concept in accordance with the invention result, especially using the design of the apparatus as described above. The layout of the housing and the design of the circuit cards here alternately influence each other essentially, wherein it becomes evident that several of the switch sliders shown, which are rigidly connected, can also act correspondingly from the edge simultaneously on different printed cards, so that use can be widely varied.

Particular difficulties occur during construction in connection with the type of apparatus described here in the "hand-held" type. Using the constructive solution selected, a large number of constructive difficulties in a constricted space have been taken into account, wherein the measures applied mutually aid each other in a surprising way.

Based on the consideration that circuit boards in printed form today are the essential connection element for electronic components, the contact surfaces 62 were applied directly to the printed circuit board 60 in a geometrically advantageous form. An ordinarily known concept was changed here in such a way that along the longitudinal sides 69 of the card contact surfaces were placed on the upper surface of one and the opposite underside of the other in such a way that a contact element 53, omega-shaped and curved in the direction of the card edges, can connect the opposite contact surfaces on the upper surface with corresponding counter contact surfaces on the underside.

Since the omega-shaped curved spring (contact element) 53 is automatically bent open by pushing on the side 69—after initial snap-on by a correspondingly changed configuration of the end pointing towards the card—its restorative force creates the necessary contact pressure. The omega-shaped contact element 53 made from a conductive spring material therefore can connect in a certain position the corresponding contact surfaces 62 of the upper surface with those of the underside of the card.

The several contact surfaces 62 on the upper surface and the underside of the board 60 are electrically connected with the remaining switch components in such a way, that they achieve the connective configurations required from time to time positionally during the translational movement of the contact element 53 in the direction of the longitudinal side 69 of the card.

Several such contact elements 53 in a switch element (switch slider) 50, 52 are placed at predetermined distances so that they, guided in parallel, connect the contact elements 62 on the upper surface and the underside in the identical configuration, respectively, so that the switch during its movement simultaneously connects several contact elements 62, opening or closing them, and in this way can perform complex switching functions.

In the switch elements 50, 52 a plurality of cuboid hollow spaces (for example 51) have been provided, into which the contact springs 53 can be inserted. These hollow spaces are formed such that each single spring 53 has a sufficient amount of mechanical freedom in the movement direction vertically to the board 60 in order to prevent measurement variations regarding the position of the board 60 themselves and those of the moving switch strap 50 from having any effect on assurance of contact, i.e. the position of the contact elements 53. In this way it is assured that the position of the contact elements 53 is exclusively determined by the geometry of the board 60 and not by the position of the switch strap 50.

The switch strap 50 is formed in such a way that during a displacement of the switch strap in the direction of the longitudinal side 69 of the board 60 the contact elements 53 are carried along so as to reach the other switch positions guided in parallel.

In actuality the switch element 50 therefore can be moved in a vertical direction to the board 60 by a few millimeters without the contact elements 53 disposed within it lifting off the contact surfaces 62. The edges of the springs can be moved in steps by the contact strap with a minimum of friction, which is aided especially by burr-free cut edges at the edges of the springs and highly polished side surfaces of the switch strap, made from an insulating plastic.

In the present embodiment this switch strap is surrounded by an additional metallic part, for example a stamped part, which in the present application serves for screening, hereinafter referred to as screen part 47.

If the switch element 50 and the screen part 47 covering it are inserted with a screw 54 into the switch 40 and are then tightened with the screw 54, the switch 40 together with the screen part 47, the switch element 50 and the contact elements 53 then form the actual switch element.

Printed circuit board is provided with a hole 61 to accommodate mounting pin 10 and is also provided with recesses 63 between the different contact surfaces. Some of the various parts of the switch element are located in the slide switch guides 63, 64, 65 and 67 which are placed around the longitudinal sides of the boards.

If a screening of the switch contact elements 53 is not necessary, the switches and the switch elements can be made from a single coherent plastic part, if desired.

The switches 40, 41 have several simultaneous functions. On the one hand they are formed such that the switch—corresponds to the function of a slide switch—because of its large surface simultaneously represents a sight cover for the recesses 89 needed in connection with the slide switch.

Since the switch button must be accessible from the outside of the apparatus, the sight cover effect and the fulfillment of the leakage distance requirement were combined in the present preferred embodiment.

A customary knurling is provided on the outside of the switch button in order to create the frictional connection with the surfaces of the hand or fingers.

The mechanical inner parts of the switch button made from a piece of plastic are made such that they can be guided in the slits of the housing in the manner of tracks.

On the underside of the switch—pointing into the inside of the apparatus—two elements 43, which can be described as spring arms, are visible which act as detent spring elements 44. The ends of spring arms 43 are formed as leaf springs and are formed cylindrically such that they form a stop together with the cylindrical pins 93 which are in the housing 85.

Furthermore, on the upper side—also pointing into the inside of the housing—there is a ridge 42 on the switch button, which serves in the inside of the apparatus for receiving the position indicating elements 45 and 46. These position indicating elements later serve, together with the transparent front part, as indicators within the apparatus scale.

In the case of application described here for the switch in accordance with the invention four complex switch component groups are provided which nevertheless take little space altogether. They are the two mode switches with the switches 41 and the two measuring range switches with the switches 40.

Furthermore it became possible that the actual contact elements 53—independent of possible variations of their positions are exclusively determined in their position by the position of the board 60 on which are contact surfaces 62.

The slide switch and the contact elements 53 moved by it take care of a degree of self-cleaning of the contact elements 62. Their contact pressure can be determined by the forming of the spring. Thus the wear of the contact surfaces can be limited.

Since the contact button simultaneously has the functions of cover, slide guidance, stop, connection element to the switch and support element for the position indicating elements 45 and 46 and, together with the plastic housing 85 forms the detent, relatively complex functions can be performed with small structural effort.

The slide switch of the exemplary embodiment here described furthermore has an additional structural peculiarity. In general, a linearly movable switching element can only be screened with a certain additional effort. Since in a rotary switch the switching movement is exclusively performed via an axle and this can be guided without difficulty through a hole provided in a screen housing, normally a rotary switch is superior in regard to use with a measuring apparatus—especially when then latter, as in the present case, is destined for a use with very broad bands—as far as screening effort and screening reliability are concerned. With the addition of a screen part 47, equipped respectively with additional sliding contacts 48 on top of the switch element 50, this difficulty was met in a structurally surprisingly simple manner.

Figure 4:
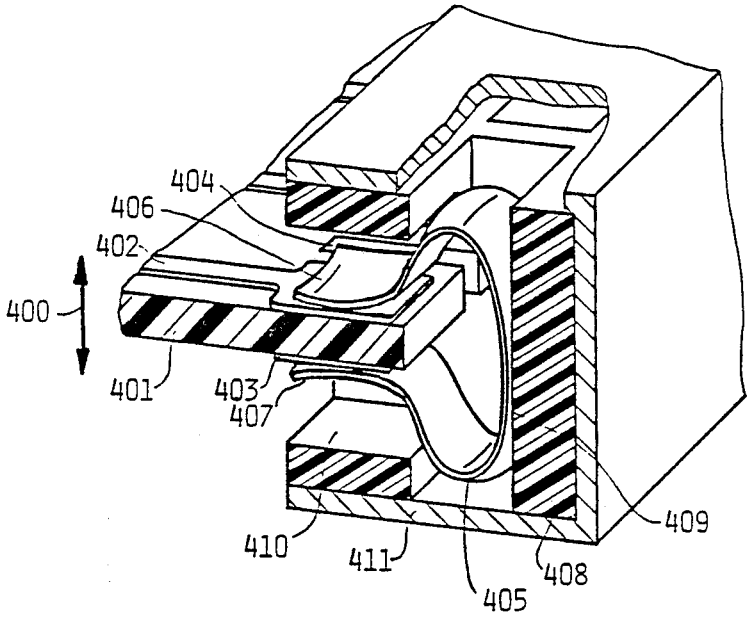
FIG. 4 is an enlarged detailed view of the switch according to the invention.

The principle of the switch according to the invention is again separately shown in enlargement in FIG. 4.

Separate contact surface 402 and 403 are provided on the upper surface and the underside of a printed circuit board 401, which is formed by gold-plated strip conductors. Recesses 404 are provided between the contact areas which see to it that worn-off materials cannot lodge between the contact surfaces and thereby create bridges.

The omega-shaped contact element 405 surrounds the edge of the printed circuit board 401 and connects the contact areas which are opposite of each other. The contact element is guided by the printed circuit board and acts on both contact surfaces with equal force. The contact element has the simplest structural shape consistent with its purpose. Because of play in a direction parallel to the pressure forces within the recess 410, the contact spring "rides" on the edge of the printed circuit board 401 and its spatial position is determined by the latter to a large degree. The mounting of the contact element within the recess 410 is floating. The ends 406 and 407 which contact the contact surfaces, show an all around convexity with the "bulge" in the direction of the printed boards for two reasons:

On the one hand the ends 406 and 407 should not "catch" on the slits present between the contact areas while changing from one contact area to the other, but should glide across smoothly.

On the other hand the contact element 405, because of the bending of its pressure surfaces in the direction towards the printed circuit board, has the feature that it can be pushed onto the printed circuit board without difficulty because of its beak-like form which can be spread at the end. If the height tolerances of the mounting within the chamber of the switch slider are not sufficient to accomodate the spatial distance differences between the printed circuit board 401 and the support element 408, the rear part of the omega can slightly turn within the chamber without significant changes in the pressure conditions. The directions of possible height differences are symbolized in FIG. 4 by a double arrow 400. If the printed circuit board moves in an upward or downward direction in the direction of the arrows, the contact element at first gives within the framework of the possible play and then rolls off on its reverse surface 409, wherein the ends 406 and 407 can also slightly "roll" on the contact surfaces 402 and 403 without a significant change in the pressure conditions in regard to the electrical contact effectiveness. Because of the rectifying move in the direction of the arrows 400, no adjustment of the contacts of this switch is necessary.

The contact elements are placed in corresponding recesses 410 of the support element 408 made from plastic, wherein the support element itself is surrounded by a screen 411 U-shaped in section. The recess 410 limits the movements of the contact element without essential play in the direction of the relative movements occuring during the switching of the contact connections. The lesser height of the opening areas towards the printed circuit card in comparison to the height of the recess prevents the contact element from falling out if the slide switch has not yet been assembled. The difference in height between chamber and opening is dimensioned such that the omega-shaped element can be snapped in without difficulty during assembly because of its resilience.

The invention in its design is not limited to the preferred exemplary embodiment shown above. A number of variations are possible which utilize the solution shown even with basically different designs.

I claim:

1. A multi-pole slide switch for an electrical signal processing apparatus comprising:

a printed circuit board having an insulated support layer and fixed contact areas provided on both sides of said insulated support layer, said insulated support layer including an edge; and a switch slider having substantially omega-shaped contact elements enclosing said edge of said support layer and resiliently contacting said contact areas that are respectively opposite one another, said switch slider being movable parallel to said edge for causing said contact elements to alternately contact different contact areas, said switch slider having chamber-like recesses in which said contact elements are loosely inserted, and said contact elements being movable in said recesses in a direction transverse to said fixed contact areas and transverse to the direction in which said switch slider is movable.

2. A slide switch in accordance with claim 1, wherein said contact elements have a dimension transverse to said fixed contact areas, said recesses being generally cuboid and have a height in the direction transverse to said fixed contact areas which is larger than the dimension of said contact elements, said recesses include a rectangular recess in a direction toward said fixed contact areas, said rectangular recess having a height which is larger than a corresponding dimension of said contact element in said rectangular recess in the direction transverse to said fixed contact areas and smaller than the dimension of said contact elements in said recesses.

3. A slide switch in accordance with claim 1, further comprising a housing having means defining a slit provided therein, said slit defining means extending in the direction of sliding movement, said switch slider further comprising an exterior operating element disposed in said slit defining means and extending in the direction of sliding movement.

4. A slide switch in accordance with claim 3, said housing further comprising guide surfaces extending in the direction of sliding movement, said guide surfaces abut against said slit defining means thereby limiting said sliding elements abutting on said guide surfaces in movement in the direction of sliding movement.

5. A slide switch in accordance with claim 4, further comprising a screen, said slit defining means being covered by said screen.

6. A slide switch in accordance with claim 1, wherein said contact areas are gold-plated and said edge has recess-like breaks between said contact areas.

7. A slide switch in accordance with claim 6, wherein said recess-like breaks and said contact areas have a dimension in the direction of sliding movement, the dimension of said recess-like breaks being smaller than the dimension of said contact areas, and said contact elements include contact surfaces, wherein said contact surfaces are convexly rounded in the direction of sliding movement.

8. A slide switch in accordance with claim 1, further comprising screening parts extending in the direction of sliding movement, wherein at least one of said contact areas and said contact elements are contacted by said screening parts, and said contact elements being insulated by said screening parts.

9. A slide switch in accordance with claim 8, further comprising a further screening part and said switch slider further comprising a sliding element for carrying said contact elements, wherein said further screening part is U-shaped and contacts said sliding element.

10. A slide switch in accordance with claim 1, further comprising resilient elements and a housing having detents, said switch slider further comprising a slide element which is movable in discrete switch positions, wherein said resilient elements are connected with said slide element and interact with said detents to hold said switch slider in said discrete switch positions.

11. A multi-pole slide switch for an electrical signal processing apparatus comprising:

a printed circuit board having an insulated support layer and fixed contact areas provided on both sides of said insulated support layer, said insulated support layer including an edge; and a switch slider having substantially omega-shaped contact elements enclosing said edge of said support layer and resiliently contacting said contact areas that are respectively opposite one another, said switch slider being movable parallel to said edge for causing said contact elements to alternately contact different contact areas, said switch slider having chamber-like recesses in which said contact elements are loosely inserted, and said contact elements being rotatably movable about an axis extending in the direction in which said switch slider is movable.

12. A slide switch in accordance with claim 11, wherein said contact elements have a dimension transverse to said fixed contact areas, said recesses being generally cuboid and have a height in the direction transverse to said fixed contact areas which is larger than the dimension of said contact elements, said recesses include a rectangular recess in a direction toward said fixed contact areas, said rectangular recess having a height which is larger than a corresponding dimension of said contact element in said rectangular recess in the direction transverse to said fixed contact areas and smaller than the dimension of said contact elements in said recesses.

13. A slide switch in accordance with claim 11, further comprising a housing having means defining a slit provided therein, said slit defining means extending in the direction of sliding movement, said switch slider further comprising an exterior operating element disposed in said slit defining means and extending in the direction of sliding movement.

14. A slide switch in accordance with claim 13, said housing further comprising guide surfaces extending in the direction of sliding movement, said guide surfaces abut against said slit defining means thereby limiting said sliding element abutting on said guide surfaces in movement in the direction of sliding movement.

15. A slide switch in accordance with claim 14, further comprising a screen, said slit defining means being covered by said screen.

16. A slide switch in accordance with claim 11, wherein said contact areas are gold-plated and said edge has recess-like breaks between said contact areas.

17. A slide switch in accordance with claim 16, wherein said recess-like breaks and said contact areas have a dimension in the direction of sliding movement, the dimension of said recess-like breaks being smaller than the dimension of said contact areas, and said contact elements include contact surfaces, wherein said contact surfaces are convexly rounded in the direction of sliding movement.

18. A slide switch in accordance with claim 11, further comprising screening parts extending in the direction of sliding movement, wherein at least one of said contact areas and said contact elements are contacted by said screening parts, and said contact elements being insulated by said screening parts.

19. A slide switch in accordance with claim 18, further comprising a further screening part and said switch slider further comprising a sliding element for carrying said contact elements, wherein said further screening part is U-shaped and contacts said sliding element.

20. A slide switch in accordance with claim 11, further comprising resilient elements and a housing having detents, said switch slider further comprising a slide element which is movable in discrete switch positions, wherein said resilient elements are connected with said slide elements and interact with said detents to hold said switch slider in said discrete switch positions.

* * * * *